US008313552B2

(12) United States Patent
Kepplinger

(10) Patent No.: US 8,313,552 B2
(45) Date of Patent: Nov. 20, 2012

(54) METHOD FOR THE PRODUCTION AND THE MELTING OF LIQUID PIG IRON OR OF LIQUID STEEL INTERMEDIATE PRODUCTS IN A MELT-DOWN GASIFIER

(75) Inventor: Leopold Werner Kepplinger, Leonding (AT)

(73) Assignees: Siemens Vai Metals Technologies GmbH (AT); Posco (KR)

( * ) Notice: Subject to any disclaimer, the term of this patent is extended or adjusted under 35 U.S.C. 154(b) by 100 days.

(21) Appl. No.: 12/742,471

(22) PCT Filed: Nov. 4, 2008

(86) PCT No.: PCT/EP2008/009277

§ 371 (c)(1),
(2), (4) Date: May 12, 2010

(87) PCT Pub. No.: WO2009/062611

PCT Pub. Date: May 22, 2009

(65) Prior Publication Data

US 2010/0294080 A1 Nov. 25, 2010

(30) Foreign Application Priority Data

Nov. 13, 2007 (AT) ..... A 1824/2007

(51) Int. Cl.
*C21B 13/02* (2006.01)
*C21C 7/072* (2006.01)

(52) U.S. Cl. ..... 75/448; 266/44; 266/80; 266/172; 266/221

(58) Field of Classification Search ..... 75/448, 75/503, 445; 266/172, 268, 221, 80, 44
See application file for complete search history.

(56) References Cited

U.S. PATENT DOCUMENTS

| | | | | |
|---|---|---|---|---|
| 3,599,949 | A * | 8/1971 | Grenfell | 266/89 |
| 4,588,437 | A | 5/1986 | Kepplinger | 75/43 |
| 4,708,736 | A | 11/1987 | Hauk | 75/26 |

FOREIGN PATENT DOCUMENTS

| | | | |
|---|---|---|---|
| AT | 382390 | B | 2/1987 |
| AT | 407398 | B | 2/2001 |
| AT | 9901455 | * | 3/2001 |
| CN | 86 1 01817 | A | 11/1986 |
| EP | 114040 | A | 7/1984 |

(Continued)

OTHER PUBLICATIONS

KR 2003-0030497, Machine translation, published Apr. 2003.*

(Continued)

*Primary Examiner* — George Wyszomierski
*Assistant Examiner* — Tima M McGuthry Banks
(74) *Attorney, Agent, or Firm* — Ostrolenk Faber LLP

(57) ABSTRACT

A method and an apparatus for the production and the melting of liquid pig iron or of liquid steel intermediate products in a melt-down gasifier, with the introduction of oxygen-containing gas streams through oxygen nozzles into the solid bed. At least one oxygen nozzle has a single gas supply and introduces at least two gas streams. Using plural gas streams from a nozzle reduces the risk of fluidization of the solid bed because the number of gas raceways in materials in the gasifier is increased.

21 Claims, 3 Drawing Sheets

FOREIGN PATENT DOCUMENTS

| | | | |
|---|---|---|---|
| EP | 0 195 770 | A | 9/1986 |
| EP | 0 823 592 | A | 2/1998 |
| EP | 905260 | A1 | 3/1999 |
| JP | 60050143 | A | 3/1985 |
| JP | 62-263906 | A | 11/1987 |
| JP | 7003318 | A | 1/1995 |
| JP | 11021610 | A | 1/1999 |
| SU | 1473716 | | 4/1989 |
| WO | WO 97/44618 | A | 11/1997 |
| WO | WO 2006/005577 | A | 1/2006 |
| ZA | 9904054 | | 12/1999 |

OTHER PUBLICATIONS

International Search Report dated Mar. 6, 2009, issued in corresponding international application No. PCT/EP2008/009277.

Office Action mailed Dec. 19, 2011 in corresponding Chinese Patent Application No. 200880115978.5.

* cited by examiner

METHOD FOR THE PRODUCTION AND THE MELTING OF LIQUID PIG IRON OR OF LIQUID STEEL INTERMEDIATE PRODUCTS IN A MELT-DOWN GASIFIER

CROSS REFERENCE TO RELATED APPLICATION

The present application is a 35 U.S.C. §§371 national phase conversion of PCT/EP2008/009277, filed Nov. 4, 2008, which claims priority of Austrian Application No. A1824/2007, filed Nov. 13, 2007, the disclosure of which is incorporated by reference herein. The PCT International Application was published in the German language.

BACKGROUND OF THE INVENTION

The application relates to a method and an apparatus for the production and the melting of liquid pig iron or of liquid steel intermediate products in a melt-down gasifier.

In methods of this type, iron oxides or pre-reduced iron or mixtures thereof are added as iron-containing batch materials to the melt-down gasifier and there are melted, with the supply of carbon-containing material as solid carbon carriers and oxygen-containing gas, in a solid bed which is formed from the solid carbon carriers, the carbon carriers being gasified and a CO- and $H_2$-containing reduction gas being generated. The oxygen-containing gas is supplied to the solid bed via a multiplicity of oxygen nozzles, called an oxygen nozzle girdle, which are distributed over the circumference of the melt-down gasifier in the region of the melt-down gasifier hearth. The oxygen nozzles penetrate through the metal casing of the melt-down gasifier and are supplied with oxygen-containing gas from outside the melt-down gasifier. The oxygen-containing gas may be oxygen or an oxygen-containing gas mixture; the terms "oxygen-containing gas" and "oxygen" are used synonymously below.

The capacity of a melt-down gasifier for producing liquid pig iron or liquid steel intermediate products or its melting capacity increases with its volume. An enlargement of the diameter, that is to say a rising cross-sectional area of the melt-down gasifier, causes the volume to rise for the given height. When the capacity of melt-down gasifiers rises due to an enlargement of the cross-sectional area, the active region of the oxygen nozzle girdle decreases in relation to the cross-sectional area of the melt-down gasifier, since the circumference of the melt-down gasifier hearth grows only linearly with the diameter of the melt-down gasifier hearth, but the cross-sectional area increases with the square of the diameter of the melt-down gasifier hearth. Since, for reasons of the strength of the metal casing of the melt-down gasifier, the spacing of the oxygen nozzles following one another in the oxygen nozzle girdle cannot be made as small as desired, the number of installable oxygen nozzles and also the circumference will increase only linearly with the diameter of the melt-down gasifier hearth, whereas the melting capacity rises at least with the square of the diameter of the melt-down gasifier hearth.

The result of this is that the oxygen nozzles used have to conduct an ever larger quantity of oxygen-containing gas into the melt-down gasifier.

Since the depth of penetration of the oxygen jet into the coke or char bed of the solid bed, which is known as the raceway, in the melt-down gasifier does not become substantially greater with an increasing gas quantity, the disadvantage of a very high local gas quantity arises. Owing to the expansion of the gas jet due to the highly exothermal gasification reaction $$C+\tfrac{1}{2}O_2 \Rightarrow CO \quad \Delta H=-110\ \text{kJ/mol}$$

which proceeds at temperatures of above 2500° C., the hot gas streams give rise in the raceway and in wide regions above the raceway to a state of fluidized bed formation or fluidization.

In this fluid-dynamic flow regime, solid particles are brought to intensive motion, so that they behave in a similar way to a liquid. For this reason, the countercurrent which is customary in shaft furnaces and is advantageous for energy exchange and mass transfer becomes a cross countercurrent which is unfavorable for the reduction and melting processes taking place in the melt-down gasifier. A further disadvantage is that a pronounced solid bed, which is necessary for the ideal gas-solid countercurrent, no longer occurs in these regions. As a result, material, such as iron ore and sponge iron having different properties, such as degree of reduction and temperature, is intermixed with slags, aggregates and degassed coal (char) which are likewise in different states. A regulated energy exchange and mass transfer is therefore possible only very incompletely.

EP0114040 describes a method in which a fluidization of the material located in front of the oxygen nozzles can be avoided by the arrangement of two nozzle levels. In this case, the lower oxygen nozzle level is supplied with a smaller quantity of oxygen-containing gas, so as to form a solid bed layer which makes it possible to have the process engineering effect of countercurrent management which, as described above, is advantageous for energy exchange and mass transfer. However, by means of this method, only a limited quantity of oxygen-containing gas can be introduced. The oxygen introduced via the upper oxygen nozzle girdle generates a fluidized bed.

A plant according to Austrian patent specification AT382390B possesses only a single oxygen nozzle level issuing into a solid bed consisting of coarse-grained batch material. This method, however, is successful only in the case of hearth diameters up to about 7 m, since, with larger diameters, the initially explained fluidization effect occurs, since the quantity of oxygen-containing gas to be introduced is too large to make it possible to have a stable solid bed. A further limiting criterion is that, when untreated coal is used, this decomposes during pyrolysis into smaller grain sizes which likewise facilitate fluidization.

SUMMARY OF THE INVENTION

The object of the present invention is to provide a method and an apparatus, by means of which it is possible, even in melt-down gasifiers with a large diameter and volume, to ensure a sufficient oxygen supply without any weakening in the strength of the steel casing of the melt-down gasifier and with a fluidization of the solid bed being avoided or reduced.

This object is achieved by means of a method for the production and the melting of pig iron and of steel intermediate products in a melt-down gasifier in a solid bed, with the supply of iron oxides or pre-reduced iron or mixtures thereof, and of carbon-containing material, the carbon-containing material being gasified by means of oxygen-containing gas introduced via oxygen nozzles, which method is characterized in that the oxygen-containing gas is introduced, in the case of at least one oxygen nozzle, in at least two gas streams into the solid bed of the melt-down gasifier or coal gasifier.

The present invention avoids the disadvantages discussed above in that, in the case of at least one oxygen nozzle, oxygen-containing gas is conducted in at least two gas streams into the solid bed. By means of this measure, it is possible, with the same number of passages for oxygen nozzles in the steel casing of the melt-down gasifier, to provide gas streams penetrating to a greater extent into the solid bed. If in each case at least two gas streams are introduced from all the oxygen nozzles, double the number of gas streams is provided, as compared with the conventional solution with one gas stream per oxygen nozzle. Consequently, the volume flows of introduced gas for a raceway in each case can be lowered, with the result that extensive fluidization can be avoided or reduced. In the event of an introduction of two gas streams of equal strength per oxygen nozzle, the volume flows of introduced gas are lowered, for example, to half, as compared with the introduction of one gas stream. If more than two gas streams per oxygen nozzle are introduced from one or more or all of the oxygen nozzles, the volume flows of introduced gas diminish to a correspondingly greater extent. Introduction of at least two gas streams may take place in the case of one or more or all of the oxygen nozzles. Two, three, four, five, six or seven gas streams per oxygen nozzle may be introduced into the solid bed. Preferably, two to four gas streams are introduced, since, with such a number, the depth of penetration of the raceway into the solid bed is good and the individual raceways do not overlap. With more than seven gas streams, the depths of penetration are low, and there is the risk of overlapping of the individual raceways.

After the oxygen nozzle has been supplied with oxygen-containing gas from outside the melt-down gasifier, the oxygen-containing gas flows as a feed gas stream through the oxygen nozzle before it is introduced into the solid bed.

According to one embodiment of the method, the at least two gas streams introduced into the solid bed originate from a single feed gas stream for oxygen-containing gas. Thus, all the gas streams introduced from an oxygen nozzle can be controlled simultaneously by controlling the feed gas stream.

According to another embodiment of the method, the at least two gas streams introduced into the solid bed originate in each case from a specific feed gas stream. This makes it possible, by controlling the corresponding feed gas stream, to control each of the introduced gas streams individually, independently of further gas streams introduced from the oxygen nozzle.

According to one embodiment of the method, gas streams having different flow directions emerge from an oxygen nozzle orifice. In comparison with the conventional introduction of a gas stream with one flow direction from an oxygen nozzle orifice, the oxygen-containing gas is thereby introduced into the solid bed over a wider region, and, for each gas stream with one flow direction, in each case a specific raceway having a smaller local gas quantity is formed, thus increasing the number of raceways and reducing the risk of fluidization.

According to another embodiment of the method, each gas stream emerges from a specific oxygen nozzle orifice. Since a specific raceway is formed in front of each oxygen nozzle orifice, the number of raceways consequently rises, and therefore the volume flow per raceway can be reduced. The risk of fluidization of the solid bed is reduced correspondingly.

Gas streams issuing adjacently from the oxygen nozzle may have identical or different flow directions. In order to ensure that the raceways caused by the individual gas streams are at a sufficient distance from one another, in a preferred embodiment the flow directions for the gas streams form an angle of up to 45°, preferably of 5° to 15°, to one another. A uniform full gassing of the melting and reaction zone in front of the oxygen nozzles thereby occurs. The larger the angle is, the more effectively are the individual raceways present in front of the same oxygen nozzle separated from one another; however, with a rising angle, the risk rises that raceways present in front of adjacent oxygen nozzles overlap one another. The angle should therefore amount to no more than 45°. Which angle is optimal depends on the proximity of adjacent oxygen nozzles to one another. With conventional numbers of oxygen nozzles on the melt-down gasifier and with the distances resulting from these, 5° to 15° is particularly beneficial.

Said angle is in this case the angle between the projections of the flow directions onto a horizontal plane.

Since the volume flows per raceway are lower when the method according to the invention is carried out, as compared with known methods with one gas stream per oxygen nozzle, there is a reduced local gas flow within the annular melting zone of a raceway. For example, when the same volume of oxygen-containing gas is introduced with two gas streams of identical size, instead of one gas stream, the local gas flow is reduced to half; with an introduction of more than two gas streams, the local gas flow decreases to a correspondingly greater extent. Owing to the reduction in the local gas flow, the gas velocity is also correspondingly lower in the zones directly above the raceways, the result being that the formation of an inadmissible intermixing of the batch materials is minimized and the advantageous gas-solid countercurrent can be ensured.

The gas streams introduced into the solid bed may have identical or different diameters. It is preferable if, when more than two gas streams are used, the gas streams have different diameters. For example, in the case of three adjacent gas streams, a middle gas stream having one diameter can be flanked by two gas streams having smaller diameters which are identical for both. The middle gas stream then penetrates further into the solid bed, and it is less likely that its raceway overlaps with the raceways of the adjacent smaller gas streams. Preferably, each feed gas stream for oxygen-containing gas can be regulated in terms of pressure and, via the flow velocity, in terms of quantity. What is achieved thereby is that the gas streams which are introduced into the solid bed and which are of course supplied with oxygen-containing gas by the feed gas streams can be regulated in terms of pressure and, via the flow velocity, in terms of quantity.

According to one embodiment of the method according to the invention, small coal is also injected into the solid bed via the oxygen nozzles. Additional carbon-containing material is thereby supplied to the solid bed.

According to a further embodiment of the method according to the invention, the operation of the oxygen nozzles is monitored by inspection devices. As a result, the state of the oxygen nozzles can be checked, and, in the case of unfavorable developments, such as, for example, a shift of the oxygen nozzle orifices, counter measures can be initiated in due time or the oxygen nozzle stopped.

A further subject according to the present invention is an oxygen nozzle for the supply of oxygen-containing gas into the solid bed of a melt-down gasifier or coal gasifier, characterized in that it has at least one oxygen feed duct and at least two oxygen stream outlet ducts with outlet orifices, each of the oxygen stream outlet ducts being connected to at least one oxygen feed duct. The oxygen nozzle may also have three, four, five, six or seven oxygen stream outlet ducts. It preferably has two to four oxygen stream outlet ducts, since, with such a number, the depth of penetration of the raceway formed in front of them into the solid bed is good, and the individual raceways do not overlap. With more than seven oxygen stream outlet ducts, the depths of penetration are low, and there is the risk of overlapping of the individual raceways.

According to one embodiment of the oxygen nozzle according to the invention, at least two oxygen stream outlet ducts are connected to the same oxygen feed duct. That is to say, the oxygen feed duct branches into at least two oxygen stream outlet ducts.

According to another embodiment, the oxygen stream outlet ducts are connected in each case to a specific oxygen feed duct.

According to one embodiment of the oxygen nozzle according to the invention, the outlet orifices of the oxygen stream outlet ducts lie within a single oxygen nozzle orifice.

According to another embodiment, the outlet orifices of the oxygen stream outlet ducts form in each case a specific oxygen nozzle orifice.

According to one embodiment, in oxygen nozzles with more than two oxygen stream outlet ducts, the diameters of the individual outlet orifices are different, so that the gas quantity and depth of penetration of the respective raceways can be adapted to the energy and geometric requirements in the melt-down gasifier.

When the outlet orifices of the oxygen stream outlet ducts form in each case a specific oxygen nozzle orifice, it is preferable if the distance between the circumferences of adjacent outlet orifices amounts to three times the outlet orifice diameter of one of the outlet orifices. In the case of outlet orifice diameters of different size, this applies to the smaller outlet orifice diameter. In an example with 3 outlet orifices, a central outlet orifice being flanked by two outlet orifices having a smaller, in each case identical, diameter, this is, for example, the smaller diameter. A greater distance would in this case present problems in still having sufficient wall thickness in the oxygen nozzle for accommodating cooling ducts.

According to one embodiment of the oxygen nozzle according to the invention, the center axes of those portions of the oxygen stream outlet ducts which end in the outlet orifices form an angle of up to 45°, preferably of 5° to 15°, to one another. The larger the angle is, the more effectively are the individual raceways present in front of the same oxygen nozzle separated from one another; however, with a rising angle, the risk rises that raceways present in front of adjacent oxygen nozzles overlap one another. The angle should therefore amount to no more than 45°. Which angle is optimal depends on the proximity of adjacent oxygen nozzles to one another. With conventional numbers of oxygen nozzles on the melt-down gasifier and with distances resulting from these, 5° to 15° is particularly beneficial.

Said angle is in this case the angle between the projections of the center axes onto a horizontal plane.

Preferably, each oxygen feed duct is provided with a regulating device for regulating the pressure and, via the flow velocity, quantity of the oxygen-containing gas fed in.

Preferably, the oxygen nozzle comprises an inspection device for observing the oxygen stream outlet ducts and their outlet orifices.

According to a further embodiment, the oxygen nozzle comprises a device for the injection of small coal.

BRIEF DESCRIPTION OF THE DRAWINGS

The present invention is described below by means of diagrammatic figures which by way of example illustrate embodiments.

DESCRIPTION OF EMBODIMENTS

The oxygen nozzles 1*a*, 1*b*, 1*c* illustrated by way of example are arranged, in a similar way to tuyers in a blast furnace, annularly at a specific distance d above the hearth on the circumference U of the melt-down gasifier and are supplied with oxygen-containing gas from outside via supply lines, not illustrated. For the sake of greater clarity, only three oxygen nozzles 1*a*, 1*b*, 1*c* are illustrated. The melt-down gasifier has the radius R. Due to high gas velocities, as a rule above 100 m/s, the raceway already described is formed in front of the oxygen nozzles. Reaction with the carbon-containing material takes place here, which is highly exothermal and serves for melting the batch materials. The nozzles must be capable of withstanding very high temperatures of up to and above 2000° C. and must therefore either be liquid-cooled or be produced from suitable refractory materials.

The oxygen-containing gas is introduced into the solid bed in two gas streams in each oxygen nozzle 1*a*, 1*b*, 1*c*, with the result that two raceways 2*a*, 2*b* are formed in front of each oxygen nozzle 1*a*, 1*b*, 1*c*. The flow directions of gas streams emerge adjacently and consequently the corresponding raceways form an angle to one another in the projection onto a horizontal plane, in this case, for example, the plane of the paper. The outlet orifices of the oxygen stream outlet ducts in each case form a specific oxygen nozzle orifice.

Figure 1:
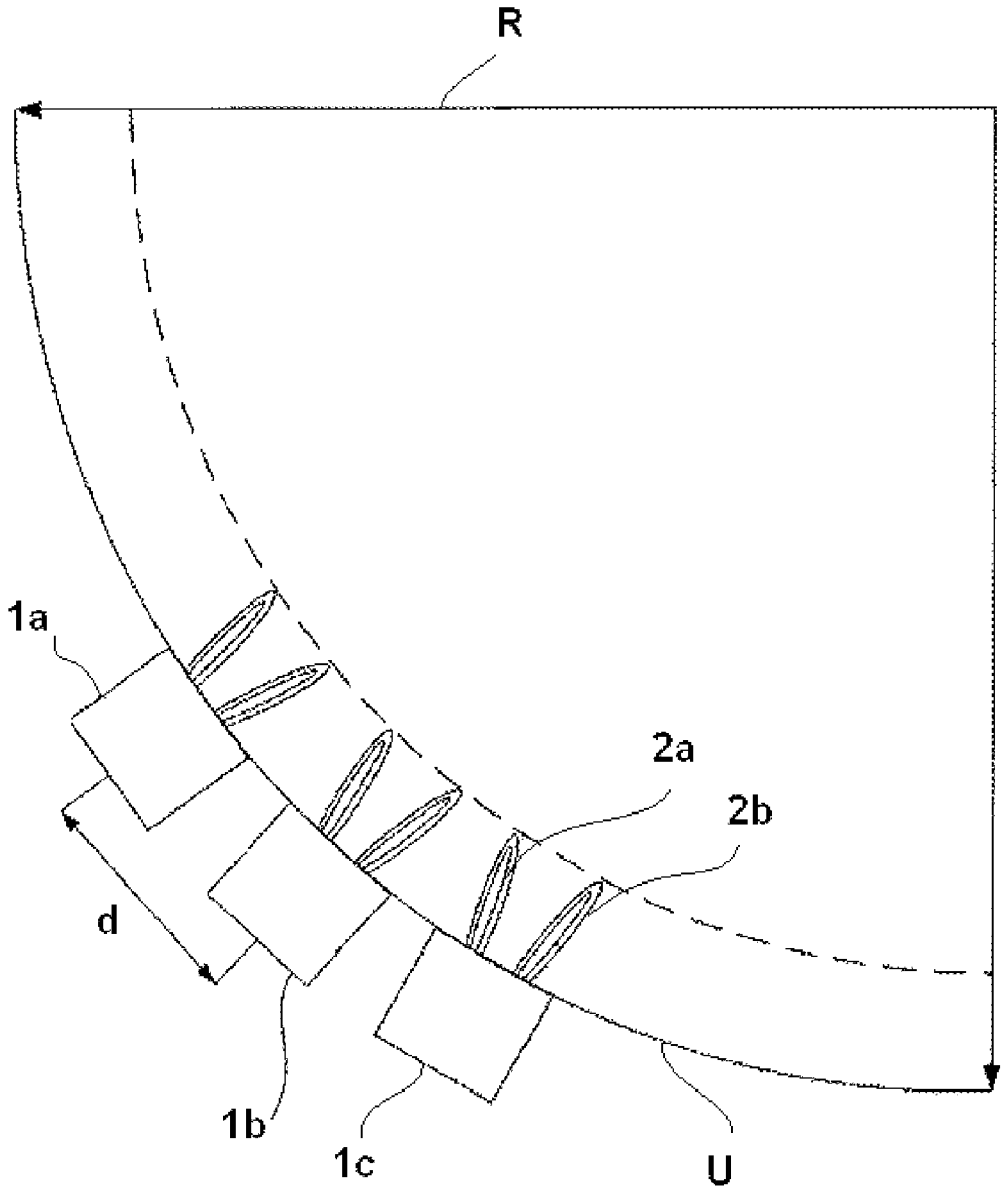
FIG. 1 shows a segment of a cross section of a melt-down gasifier in the hearth region of the melt-down gasifier.
Figure 2:
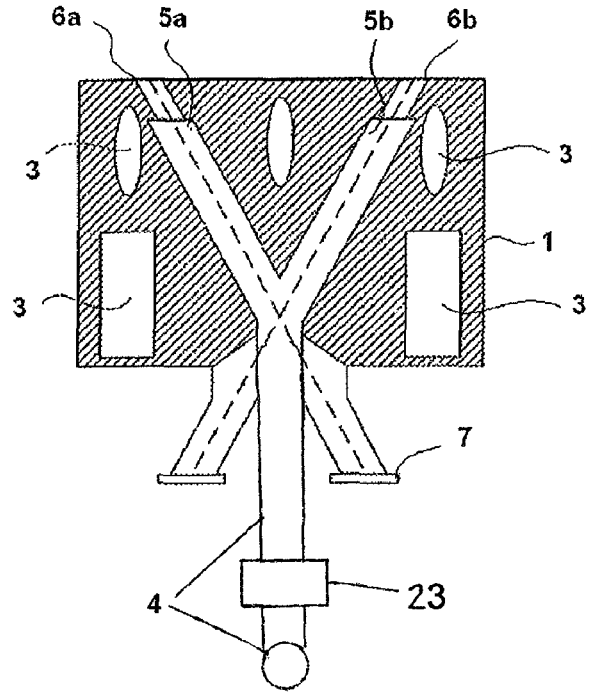
FIG. 2 shows an oxygen nozzle in cross section.

FIG. 2 shows an oxygen nozzle 1 in cross section. The oxygen nozzle 1 has cooling ducts 3 for cooling the tip and the body of the oxygen nozzle. For cooling, coolant flows through these cooling ducts 3. After the oxygen nozzle has been supplied with oxygen-containing gas from outside the melt-down gasifier, the oxygen-containing gas flows as a feed gas stream through the oxygen feed duct 4 of the oxygen nozzle, before it is introduced into the solid bed through the two oxygen stream outlet ducts 5*a*, 5*b*, branching off from the oxygen feed duct 4, and their outlet orifices 6*a*, 6*b*. The oxygen feed duct 4 has a regulating device 23 for regulating the pressure and quantity of the oxygen-containing gas fed in by the oxygen feed duct 4.

The oxygen stream outlet ducts and their outlet orifices can be observed via inspection glasses 7 as an inspection device.

Such inspection devices for monitoring the nozzle function are possible by means of rectilinear oxygen stream outlet ducts. Devices, optionally present, for the injection of small coal, which penetrates through the body of the oxygen nozzle and ends in the immediate vicinity of the outlet orifices on the side of the raceway, are not illustrated.

Figure 3A:
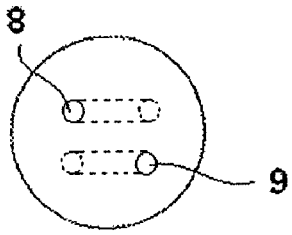
FIG. 3*a* shows diagrammatically a front view of an embodiment of an oxygen nozzle with 2 oxygen stream outlet ducts.

FIG. 3*a* shows diagrammatically a front view of an embodiment of an oxygen nozzle with 2 oxygen stream outlet ducts, the outlet orifices 8 and 9 of which form in each case specific oxygen nozzle orifices. The 2 oxygen stream outlet ducts are connected in each case to a specific oxygen feed duct. The oxygen stream outlet ducts and oxygen feed ducts which belong together have the same direction. In a projection onto a horizontal plane, the two directions of the oxygen stream outlet ducts cross over one another.

Figure 3B:
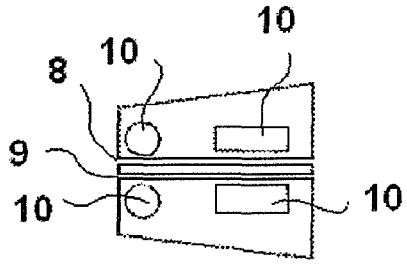
FIG. 3*b* shows a longitudinal section of the oxygen nozzle of FIG. 3*a*.

The advantage of this embodiment is the individual regulatability of the gas stream through each of the outlet orifices 8 and 9. FIG. 3*b* shows a longitudinal section of the oxygen nozzle of FIG. 3*a* with cooling ducts 10 for cooling the body and tip of the oxygen nozzle.

Figure 4A:
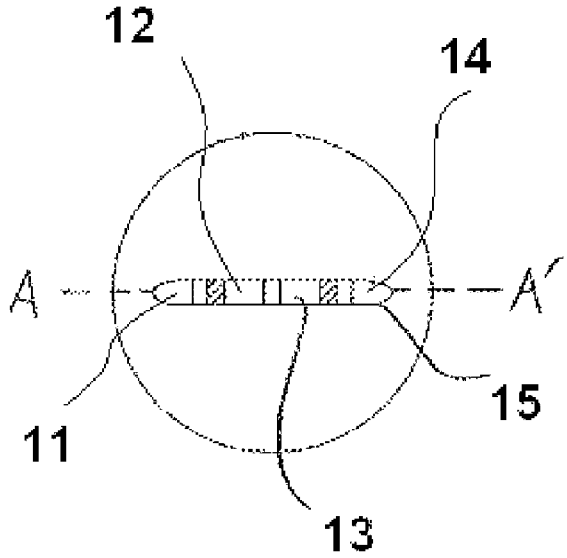
FIG. 4*a* shows a front view of an oxygen nozzle.
Figure 4B:
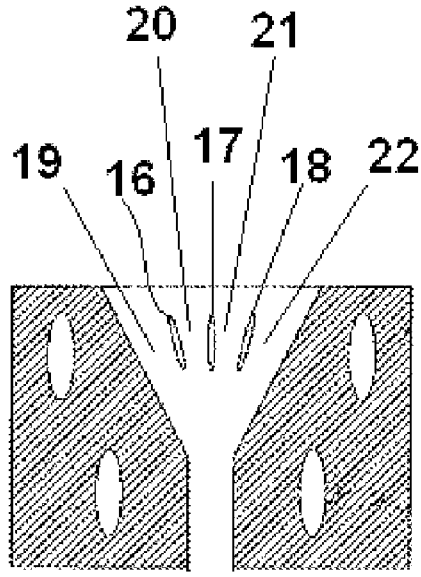
FIG. 4*b* shows a top view of a section along the line A-A' through the oxygen nozzle shown in FIG. 4*a*.

FIG. 4*a* shows a front view of an oxygen nozzle, in which the outlet orifices 11,12,13,14 of the oxygen stream outlet ducts lie within an oxygen nozzle orifice 15. The oxygen nozzle orifice is slit-shaped and is arranged horizontally. FIG. 4*b* shows a top view of a section along the line A-A' through the oxygen nozzle shown in FIG. 4*a*. Four oxygen stream outlet ducts 19,20,21,22 are delimited by the three guide plates 16, 17, 18. The gas streams emerging from these possess different flow directions.

Characteristic values for melt-down gasifiers having a different melting capacity are compared below:

In this case, the terms used have the following meanings:

absolute melting capacity (tons/day)

This value indicates the quantity of pig iron which is generated daily in normal operation.

specific hearth load (tons/m$^2$, day)

This is the absolute melting capacity of pig iron related to one square meter of hearth area of the melt-down gasifier. This value characterizes the energy intensity of a melt-reduction plant.

individual melting capacity of a raceway (tons/day)

This value characterizes the melting capacity of pig iron of an individual raceway.

Advantageous conditions prevail when the numerical values for the individual melting capacity of a raceway and for the specific hearth load are approximately equal.

Examples of melt-down gasifiers with conventional oxygen nozzles in which a gas stream of oxygen-containing gas is introduced into the solid bed by each oxygen nozzle follow:

EXAMPLE 1

A melt-down gasifier with an absolute melting capacity of 1000 tons of pig iron/day is characterized by the following parameters:

| | |
|---|---|
| Total number of raceways | 20 |
| Total number of oxygen nozzles | 20 |
| Absolute melting capacity | 1000 t/d |
| Hearth diameter | 5.5 m |
| Individual melting capacity of a raceway | 50 t/d |
| Specific hearth load | 45 t/m$^2$, d |

EXAMPLE 2

A melt-down gasifier with an absolute melting capacity of 2500 tons of pig iron/day is characterized by the following parameters:

| | |
|---|---|
| Total number or raceways | 28 |
| Total number of oxygen nozzles | 28 |
| Absolute melting capacity | 2500 t/d |
| Hearth diameter | 7.5 m |
| Individual melting capacity of a raceway | 89 t/d |
| Specific hearth load | 57 t/m$^2$, d |

EXAMPLE 3

A melt-down gasifier with an absolute melting capacity of 4000 tons of pig iron/day is characterized by the following parameters:

| | |
|---|---|
| Total number of raceways | 30 |
| Total number of oxygen nozzles | 30 |
| Absolute melting capacity | 4000 t/d |
| Hearth diameter | 8.9 m |
| Individual melting capacity of a raceway | 133 t/d |
| Specific hearth load | 65 t/m$^2$, d |

EXAMPLE 4

A melt-down gasifier with an absolute melting capacity of 5800 tons of pig iron/day is characterized by the following parameters:

| | |
|---|---|
| Total number of raceways | 34 |
| Total number of oxygen nozzles | 34 |
| Absolute melting capacity | 5800 t/d |
| Hearth diameter | 10.2 m |
| Individual melting capacity of a raceway | 171 t/d |
| Specific hearth load | 71 t/m$^2$, d |

As can be seen from the examples, the individual melting capacity of a raceway arises superproportionally to the specific hearth loads.

Higher melting capacities necessitate a higher introduction of energy which is achieved by means of a higher reaction of carbon with oxygen. The generated gasification gas quantity of carbon monoxide rises proportionately with the increase in the quantity of oxygen supplied. Increasing gas quantities result in increasingly more pronounced formations of fluidized zones above the raceways, this having an adverse effect on the stability of mass transfer and energy exchange in the melt-down gasifier. So that the favorable conditions, such as are shown in examples 1 and 2, can be achieved even for larger units, more oxygen nozzles than are possible in present-day plants for stability reasons would have to be provided.

According to the invention, instead of oxygen nozzles out of which only one gas stream emerges, oxygen nozzles are installed, out of which at least two gas streams are introduced into the solid bed. Consequently, the energy released per introduced gas stream as a result of the reaction of oxygen-containing gas with carbon-containing material can be lowered. At the same time, the introduction of energy is distributed more uniformly over the circumference of the melt-down gasifier.

Examples with oxygen nozzles according to the invention follow:

EXAMPLE 5

A melt-down gasifier with an absolute melting capacity of 2500 tons of pig iron/day With a good burden distribution, oxygen nozzles according to the invention are not absolutely necessary for achieving good conditions in the solid bed, but in the case of unfavorable raw materials a 50% rise in the gas streams introduced from 28 to 42 is advantageous. This may be achieved by means of an alternating arrangement of conventional oxygen nozzles and oxygen nozzles according to the invention:

| | |
|---|---|
| Total number of oxygen nozzles | 28 |
| Total number of raceways | 42 |

The following characteristic quantities are consequently obtained:

| | |
|---|---|
| Individual melting capacity of a raceway | 59 t/d |
| Specific hearth load | 57 t/m$^2$, d |

The two numerical values are adapted again by means of this measure.

EXAMPLE 6

A melt-down gasifier with an absolute melting capacity of 4000 tons of pig iron/day In this case, when conventional oxygen nozzles are used, the deviation of the numerical values for the individual melting capacity of a raceway and for the specific hearth load differs greatly, to be precise 133 to 65. In this case, the aim is to have a doubling of the number of raceways. This can be achieved by means of the sole use of oxygen nozzles according to the invention, resulting in 2 gas streams being introduced for each oxygen nozzle into the solid bed.

| | |
|---|---|
| Total number of oxygen nozzles | 30 |
| Total number of raceways | 60 |

The following characteristic quantities are obtained:

| | |
|---|---|
| Individual melting capacity of a raceway | 67 t/d |
| Specific hearth load | 65 t/m$^2$,d |

The two numerical values are adapted again by means of this measure.

A further advantage of the oxygen nozzles according to the invention is that they can be retro fitted into existing melt-down gasifier plants, without the melt-down gasifiers being changed.

The invention claimed is:

1. A method for producing and melting of pig iron and of steel intermediate products in a melt-down gasifier having a solid bed in the gasifier, comprising:

supplying iron oxides or pre-reduced iron or mixtures thereof and supplying carbon-containing material in the gasifier, wherein carbon-containing material defines the solid bed in the gasifier, gasifying the carbon-containing material of the solid bed by introducing oxygen-containing gas via oxygen nozzles, and at least one oxygen nozzle introducing the oxygen-containing gas in at least two gas streams into the solid bed of the melt-down gasifier, adjacent gas streams emerging from the at least one oxygen nozzle having respective flow directions that form an angle of 5° to 15° to one another.

2. The method as claimed in claim 1, further comprising supplying a single feed gas stream for oxygen-containing gas to the at least one oxygen nozzle and dividing the single feed gas stream into the at least two gas streams in the at least one oxygen nozzle.

3. The method as claimed in claim 1, wherein the at least two gas streams originate from a specific feed gas stream for oxygen-containing gas.

4. The method as claimed in claim 2, further comprising directing the two gas streams to have different flow directions as each gas stream emerges from an oxygen nozzle orifice.

5. The method as claimed in 2, wherein each gas stream emerges from a specific oxygen nozzle orifice.

6. The method as claimed in claim 2, wherein the gas streams have different respective diameters.

7. The method as claimed in claim 6, wherein the at least one nozzle introduces more than two of the gas streams.

8. The method as claimed in claim 6, wherein there are more than two gas streams, and at least some of the gas streams have different respective diameters.

9. The method as claimed in claim 1, further comprising regulating a quantity and a pressure of each feed gas stream of each oxygen nozzle for oxygen-containing gas.

10. The method as claimed in claim 1, further comprising injecting small coal into the solid bed via the oxygen nozzles.

11. A method for producing and melting of pig iron and of steel intermediate products in a melt-down gasifier having a solid bed in the gasifier, comprising:

supplying iron oxides or pre-reduced iron or mixtures thereof and supplying carbon-containing material in the gasifier, wherein carbon-containing material defines the solid bed in the gasifier, gasifying the carbon-containing material of the solid bed by introducing oxygen-containing gas via oxygen nozzles, and at least one oxygen nozzle introducing the oxygen-containing gas, in at least two gas streams into the solid bed of the melt-down gasifier or coal gasifier, and monitoring operation of the oxygen nozzles through inspection holes in the nozzles.

12. At least one oxygen nozzle for the supply of oxygen-containing gas into a solid bed of a melt-down gasifier or coal gasifier, wherein the gasifier comprises a body for holding carbon containing material which forms the solid bed, oxygen-containing gas, pig iron and steel intermediate products, and the at least one oxygen nozzle;

the at least one oxygen nozzle having at least one oxygen feed duct extending into the at least one oxygen nozzle for receiving oxygen-containing gas, the at least one oxygen nozzle comprising at least two oxygen stream outlet ducts with outlet orifices, each of the oxygen stream outlet ducts being connected to the at least one oxygen feed duct, center axes of adjacent oxygen stream outlet ducts forming an angle of 5° to 15° to one another.

13. The at least one oxygen nozzle as claimed in claim 12, further comprising at least two of the oxygen stream outlet ducts connected to the same oxygen feed duct.

14. The at least one oxygen nozzle as claimed in claim 12, wherein each oxygen stream outlet duct is connected to a specific oxygen feed duct.

15. The at least one oxygen nozzle as claimed in claim 12, wherein the outlet orifices of the oxygen stream outlet ducts lie within a single oxygen nozzle orifice.

16. The at least one oxygen nozzle as claimed in claim 12, wherein the outlet orifices of the oxygen stream outlet ducts form in each case a specific oxygen nozzle orifice.

17. The at least one oxygen nozzle as claimed in claim 12, further comprising more than two of the oxygen stream outlet ducts.

18. The at least one oxygen nozzle as claimed in claim 17, wherein a distance between respective circumferences of adjacent ones of the outlet orifices is about three times an outlet orifice diameter of one of the outlet orifices.

19. The at least one oxygen nozzle as claimed in claim 17, wherein respective diameters of at least two of the individual outlet orifices are different.

20. The at least one oxygen nozzle as claimed in claim 12, wherein each oxygen feed duct has a regulating device for regulating a pressure and quantity of the oxygen-containing gas fed in by each oxygen feed duct.

21. The at least one oxygen nozzle as claimed in claim 12, further comprising an inspection device configured and located at the nozzle for enabling observation of the oxygen stream outlet ducts and their outlet orifices.

* * * * *